United States Patent [19]

Minden

[11] Patent Number: 5,035,069

[45] **Date of Patent: * Jul. 30, 1991**

[54] BALLET SLIPPER AND METHOD OF MANUFACTURING A BALLET SLIPPER

[76] Inventor: Elizabeth G. Minden, 140 W. 16th St., Apt. 5W, New York, N.Y. 10011

[ * ] Notice: The portion of the term of this patent subsequent to Feb. 20, 2007 has been disclaimed.

[21] Appl. No.: 439,449

[22] Filed: Nov. 20, 1989

Related U.S. Application Data

[63] Continuation-in-part of Ser. No. 169,970, Mar. 18, 1988.

[51] Int. Cl.[5] ..... A43B 3/00

[52] U.S. Cl. ..... 36/113; 36/8.3

[58] Field of Search ..... 36/8.3, 113, 93

[56] References Cited

U.S. PATENT DOCUMENTS

| | | | |
|---|---|---|---|
| 1,520,708 | 12/1924 | Goldstein et al. | 36/8.3 |
| 1,689,535 | 10/1928 | Rovick | 36/113 |
| 1,704,281 | 5/1929 | Capezio | 36/113 |
| 1,854,642 | 4/1932 | Brodick | 36/8.3 |
| 1,891,022 | 12/1932 | Capezio | 36/8.3 |
| 1,953,659 | 4/1934 | Savino | 36/8.3 |
| 2,110,890 | 3/1938 | Paul | 36/104 X |
| 2,701,925 | 2/1955 | Luhr | 36/72 |
| 2,810,214 | 10/1955 | Wolfe | 36/8.3 |
| 3,797,137 | 3/1974 | Harkness | 36/113 |
| 3,895,405 | 7/1975 | Edwards | 12/146 M |
| 4,026,046 | 5/1977 | Clark et al. | 36/113 |
| 4,199,878 | 4/1980 | Wossner | 36/113 |
| 4,216,131 | 8/1980 | Himes et al. | 260/33.6 |
| 4,412,393 | 11/1983 | Terlizzi et al. | 36/113 |
| 4,453,996 | 6/1984 | Terlizzi et al. | 156/227 |
| 4,901,453 | 2/1990 | Gaynor | 36/113 |

FOREIGN PATENT DOCUMENTS

| | | | |
|---|---|---|---|
| 30125 | 11/1930 | Australia | 36/8.3 |

*Primary Examiner*—David T. Fidei
*Assistant Examiner*—BethAnne C. Cicconi
*Attorney, Agent, or Firm*—St. Onge Steward Johnston & Reens

[57] ABSTRACT

A ballet slipper and method of manufacturing the same is disclosed. The slipper has an integral shank and toe box molded from a flexible thermoplastic polymeric material which can be adjusted by the dancer to conform to her foot. The toe box has a platform at its forward end which is connected by a curved radius to the shank. A layer of resilient polymeric material lines the interior of the upper portion of the toe box and extends backwardly from the edges of the toe box. A layer of shock absorbing material covers at least a portion of the upper and lower surfaces of the shank, and the platform and curved radius of the toe box. A wicking outer covering fits over the integral shank and toe box and has an elasticized throat and a panel formed from a durable non-slip material to cover the platform and curved radius of the toe box.

20 Claims, 2 Drawing Sheets

BALLET SLIPPER AND METHOD OF MANUFACTURING A BALLET SLIPPER

This is a continuation-in-part Ser. No. 07/169,970 filed on Mar. 18, 1988.

FIELD OF THE INVENTION

The present invention relates to footwear, and particularly to ballet slippers and a method of manufacturing the same.

PRIOR ART

The design and materials of the ballet slipper used by a dancer performing "sur les pointes" have generally been unchanged since the original conception of such "pointe shoes" or "toe shoes". The traditional blocked ballet slipper is made by hand on a last, using layers of fabrics, cardboard, paper and/or leather saturated with glue to form a reinforced toe box joined to a leather or cardboard shank. A reinforcing stiffener is sometimes included. Usually the outer sole is made from leather. An outer fabric or "upper" is sewn to the sole and usually gathered in pleats under the toe. This type of slipper is labor intensive and expensive to produce, although some improved casting methods have been developed to speed the laminating steps, for example as disclosed in U.S. Pat. No. 4,453,966 to Terlizzi.

The traditional ballet slipper requires extensive breaking-in before it is comfortable for use. Typically, a ballerina will break in the slipper by manually flexing it, or applying force by way of slamming the slipper in a door or bashing it with a hammer, or soaking it in warm water or alcohol. It can take as much as three hours to prepare a single pair of slippers for a performance if they have been manufactured using an epoxy or other durable glue as a laminant. Once the slipper is broken in, it will have an extremely short useful life, usually no more than twenty to forty-five minutes during a performance The short useful life is attributable to the deterioration of the toe box and/or shank caused by the rapid breakdown of the glue used to form the laminates of the toe box. The breakdown can be accelerated by perspiration during energetic dancing. Once the shank and/or toe box have deteriorated, the slipper is useless, because there will be no support for the dancer.

A further problem encountered with the traditional ballet slipper is that the outer covering (typically a satin material) is slippery, and can contribute to slips and falls when the ballerina is rising to the pointe position. The ballerina will usually darn the toes of the slipper and rub the tips in resin to minimize the chances of slipping. Nevertheless, falls do occur.

The traditional ballet slipper is uncomfortable. The toe box compresses the side of the feet, and may exacerbate problems of tendonitis, bunions and stress fractures associated with the hopping and leaping on pointe required by ballet choreography. In addition, the ballet slipper is noisy: the sound caused by the hard toe box striking a floor can detract from the illusion of effortless grace for which a dancer always strives. Efforts by the ballerina to soften the impact of the slipper on the floor can detract from the continuity and flow of a performance and also may promote strains and other injuries.

In recent years several designs for a sturdier ballet slipper formed from polymeric materials have been proposed. U.S. Pat. No. 3,797,137 to Harkness discloses a unitary plastic base having a foot supporting section and a toe box. A fabric upper is attached to the base section, but leaves the plastic toe exposed. It has been found that such exposed plastic toe boxes are extremely noisy in use, and that the exposed plastic toe can be very slippery. Furthermore, the base is disclosed as being formed from polyvinylchloride, which to be comfortable, must be specifically molded for a particular dancer's foot. The manufacture of individual molds and lasts for a particular dancer can be very expensive. In addition, the plastic base cannot be broken in like the traditional ballet slipper, and thus this design for a ballet slipper is extremely uncomfortable, even when properly molded to a particular dancer's requirements.

U.S. Pat. No. 4,026,046 to Clark discloses a relatively rigid polymeric shank and toe box unit having an open toe into which is fitted a moldable toe insert. The disclosed slipper does not address the problems of noise associated with the use of plastic materials.

U.S. Pat. No. 4,199,878 to Wossner shows an integral shank and toe box unit in a plastic ballet slipper. This slipper suffers the same drawbacks of the other plastic slipper designs, namely, it is noisy, uncomfortable, and once molded, cannot be broken in to provide a more comfortable fit. Further, certain virtuoso steps such as hopping on pointe are very difficult to perform in these shoes because of the rigidity and small size of the section connecting the platform at the front of the toe box and the shank, and further because of the insufficient support provided in the top of the toe box.

Therefore, it can be seen that there is no ballet slipper known or available which combines the virtues of durability with comfort and adjustability to the shape of a dancer's foot, and quietness on impact.

SUMMARY OF THE INVENTION

It is an object of the present invention to provide a ballet slipper which is durable and comfortable, and which reduces the noise caused by the slipper impacting on a dance floor. It is a further object of the present invention to provide a slipper which can be adjusted by the dancer to fit the dancer's foot.

These objects, and other objects which will become apparent from the description that follows, are achieved by a ballet slipper comprising an integral shank and toe box formed from a flexible thermoplastic polymeric material. The toe box includes a platform at its forward end and a curved radius joining the platform and the shank. The curved radius is rounded and larger than the edge joining the platform to the toe box in prior art slippers. A soft, resilient polymeric material lines the upper portion of the toe box and extends backwardly from the edges of the toe box. A resilient shock absorbing layer of material or combination of materials covers the upper and/or lower surfaces of the shank, and/or the exterior surface of the curved radius and the platform of the toe box. A stiffener may be mounted in a cavity formed in the underside of the shank and/or encapsulated within the shank by overmolding. Preferably, the thermoplastic material forming the integral shank and toe box has a softening point between about 120° F. and 220° F., and is either an ionomer resin, an ethylene-vinyl acetate (EVA) copolymer, a polyurethane, a thermoplastic rubber or a co-polyester elastomer. Most preferably it comprises an ionomer resin. Preferably the soft resilient toe box inner lining is a foam comprising a polyurethane, a cross-linked polyethylene, a polyvinylchloride and nitrile rubber blend or a ethylene-vinylacetate (EVA) copolymer. The resilient shock absorbing shank and/or toe box outer layers are a foam comprising an ethylene-vinyl-acetate copolymer, a neoprene rubber or a polyurethane, or a combination of these materials. Most preferably, the resilient shock absorbing shank and/or toe box layers comprise an open celled polyurethane foam.

An outer covering is fitted over the shank and toe box. Preferably the outer covering is of a type to wick moisture away from the dancer's foot to the outer surface of the covering. The outer covering has a panel formed from a durable non-slip material, preferably canvas, to cover the platform and curved radius of the toe box. The outer covering has an elasticized throat to hold the slipper onto the dancer's foot, and may have at least one elasticized panel in one side or end to insure a secure fit.

An outer sole formed from a shock absorbing resilient material, preferably an ethylene-vinyl acetate copolymer, is secured to the outer covering adjacent to the underside of the shank.

Another aspect of the present invention is a method of manufacturing a ballet slipper, comprising the steps of molding an integral shank and toe box from a flexible thermoplastic polymeric material, the toe box having a platform at its forward end and a curved radius connecting the platform with the shank; lining the interior of the upper portion of the toe box with a soft, resilient material sized to extend backwardly from the edges of the toe box; and attaching a resilient shock absorbing layer of material to the upper and/or lower faces of the shank, and/or to the curved radius and platform. Preferably, the shank and toe box thermoplastic polymeric material has a softening point between about 120° F. and 220° F. and is an ionomer resin, an ethylene-vinyl-acetate copolymer, a polyurethane, a thermoplastic rubber, or a co-polyester elastomer. The resilient material lining the inside of the toe box is a foam comprising a polyurethane, a cross-linked polyethylene or a polyvinylchloride and nitrile rubber blend, or an EVA. The resilient shock absorbing shank and/or toe box covering layers are preferably a foam comprising an ethylene-vinyl-acetate copolymer, a neoprene rubber, a polyurethane, or a combination of these materials. Most preferably the shock absorbing material is an open-celled polyurethane foam. A stiffener may be mounted on the underside of the shank or encapsulated within the shank. An outer covering having a panel formed from a durable non-slip material, preferably canvas, for covering the platform and curved radius is then fitted over the toe box and shank; and an outer sole formed from a shock absorbing material is then secured to the outer covering adjacent to the underside of the shank. Preferably, the shock absorbing outer sole material comprises an ethylene-vinyl acetate copolymer.

DETAILED DESCRIPTION OF THE PREFERRED EMBODIMENT

Figure 3:
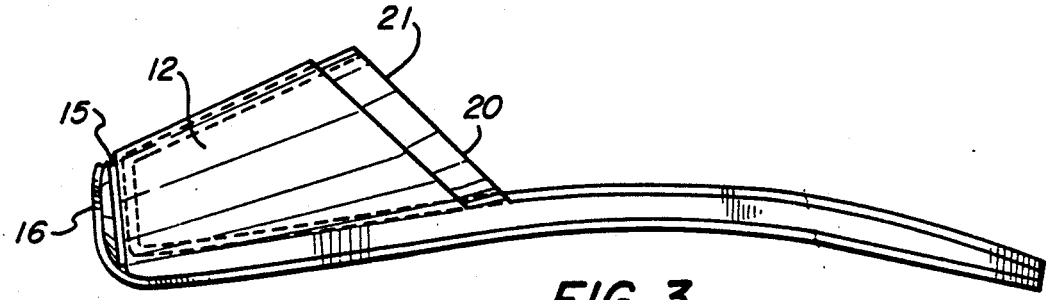
FIG. 3 is a side view of the ballet slipper without an outer covering.

The invention will now be illustrated further with respect to the drawings. Although the description and drawings generally describe a ballet slipper which can be fitted to either the left or right foot, it is to be understood that the present invention encompasses ballet slippers whether made as a pair for a left and right foot or as individual slippers made for use on either foot.

With reference to FIG. 1, 2, 3 and 4, the ballet slipper 10 comprises an integral toe box 12 and shank 14 formed from a flexible thermoplastic polymeric material. The thermoplastic polymeric material should be selected to have a softening point above the temperature which the shoe reaches during a performance due to the heat of friction of the shoe on a dance floor, stage lights, and body heat. The thermoplastic material should have a softening point which will allow the dancer to easily adjust the shank and toe box to the shape of her foot, for example, by using a conventional blow drier to heat the material until it is malleable, and then applying manual pressure to shape the shank and toe box to the shape of her foot. Preferably the thermoplastic material will have a softening point between about 120° F. to about 220° F. Preferably, the thermoplastic material comprises an ionomer resin, an ethylene-vinyl-acetate copolymer ("EVA"), a polyurethane, a thermoplastic rubber or a co-polyester elastomer. Most preferably the thermoplastic material is an ionomer resin such as that manufactured and sold by the E.I. duPont de Nemours Co. under the registered trademark Surly. Surlyn has a published softening point of about 160° F. It is to be understood that other materials having the desired thermoplastic properties may be used within the scope of the invention, and further that mixtures of the above resins may be used to achieve the desired results.

In contrast to the traditional ballet slipper which can only be broken in by considerable time and effort, the present invention allows a dancer to quickly and easily break in and customize the slipper. In contrast to the prior art plastic ballet slippers which could not be broken in at all, the present invention provides a durable ballet slipper which can be fitted comfortably to a dancer's feet, eliminating the need for costly individual molds and lasts for each dancer.

The toe box 12 has at its forward end a platform 16 which provides a flat surface for the dancer's maneuvers on pointe. A curved radius 18 joins the platform 16 to the shank 14. The curved radius 18 improves over the sharp edge which connects the platform to the shank in prior art slippers, as it allows for better control by the dancer of the speed and motion of the foot as the dancer rises from a flat footed stance to the pointe position and vice-versa. In addition, the broad curve of radius 18 makes it easier to perform steps such as hopping on pointe.

Figure 1:
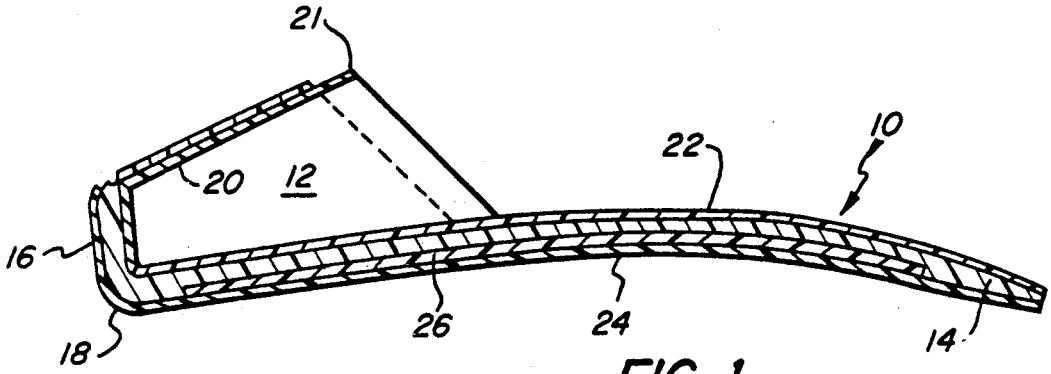
FIG. 1 is a cross-sectional view of the ballet slipper of the present invention without an outer covering.

Toe box 12 is generally wedge shaped as shown in FIG. 1, so as to support the dancer's foot primarily from the top and bottom of the foot when on pointe, rather than primarily from the sides as in the uncomfortable cylindrical toe box of the traditional ballet slipper design. Preferably a groove 15 is provided in the outer surface of toe box 12 surrounding platform 16.

Figure 4:
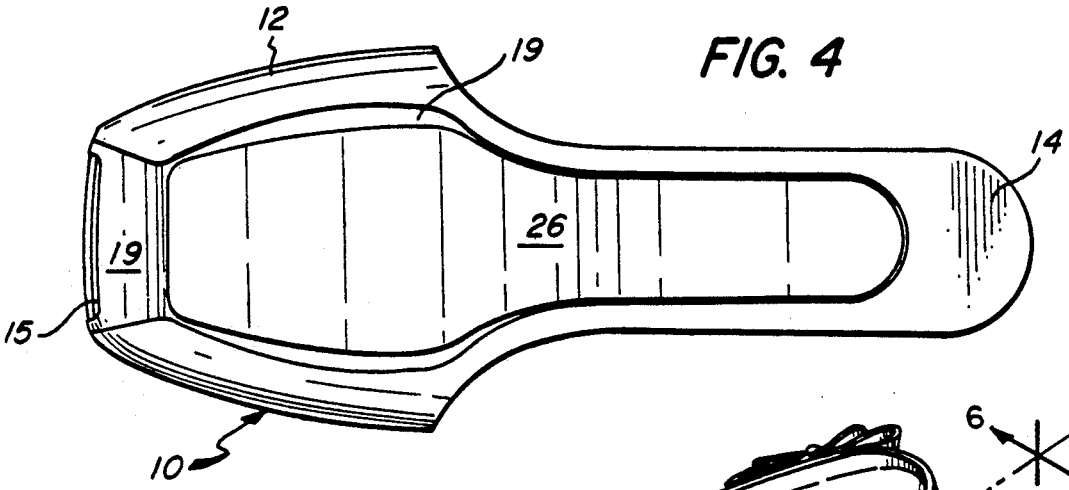
FIG. 4 is a bottom plan view of the ballet slipper showing the paddle shaped stiffener.

Shank 14 is preferably a full shank, which is sized to extend backwardly from the toe box 12 for a distance equal to the length of the dancer's foot. However, a half shank or three-quarters shank may also be utilized within the scope of the invention. Shank 14 preferably has formed in its lower surface a cavity 19 which is generally paddle-shaped and which extends forwardly to curved radius 18 as shown in FIG. 4. The stiffener can likewise be of half or three-quarter size.

Figure 2:
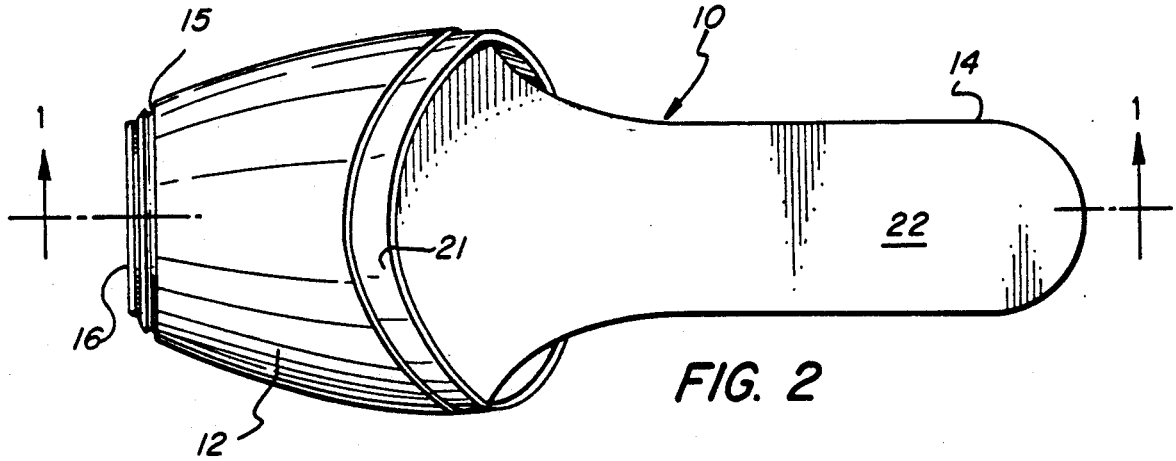
FIG. 2 is a top plan view of the ballet slipper of the present invention before fitting of the outer covering.

A layer of soft resilient polymeric material 20 lines the interior of the upper portion of toe box 12. Resilient material 20 extends backwardly from the edges of the toe box 12 in area 21, as can be seen in FIGS. 2 and 3. The resilient material in area 21 provides critical cushioning for the bunion joint which supports much of the dancer's weight in the pointe position. Preferably, the resilient material 20 comprises a foam formed from a material selected from the group consisting of polyurethane, cross-linked polyethylene, a polyvinylchloride and nitrile rubber blend or EVA. Soft resilient material 20 is about 1/16 inch thick, and may either be molded to fit into the toe box 12, or die cut from a flat sheet of material and fitted into toe box 12. Resilient material 20 may be either glued in place, or it may be removably mounted in the toe box 12.

Figure 6:
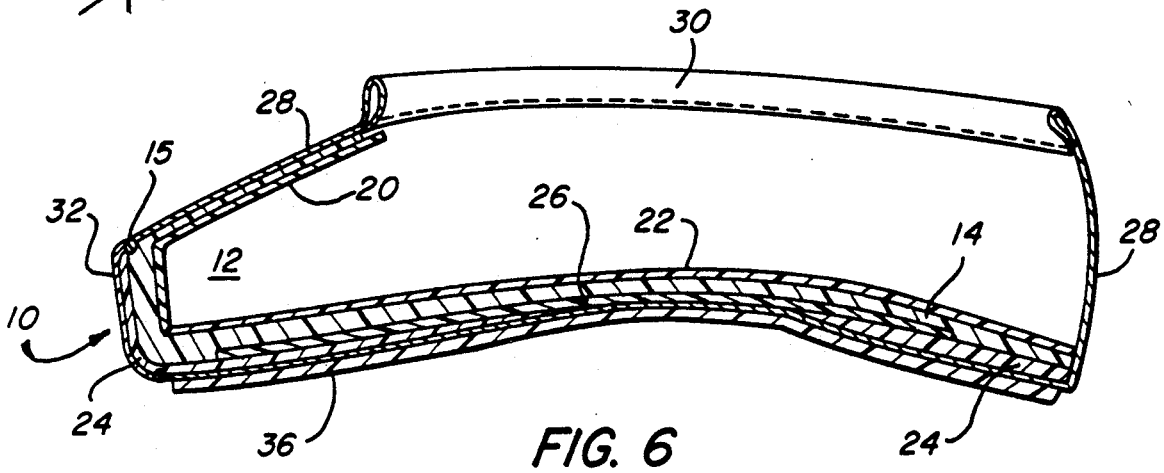
FIG. 6 is a cross-sectional view of the assembled ballet slipper.

A first layer of resilient shock absorbing material 22 covers at least a portion of the upper surface of the shank 14 and may extend to cover the interior of the toe box 12 adjacent the platform 16 and radius 18. A second layer of resilient shock absorbing material 24 covers at least a portion of the lower surface of the shank 14. The shock absorbing material 24 may cover the entire underside of the shank 14 or may cover only portions of the underside of the shank 14. For example, as shown in FIG. 6, the shock absorbing material 24 can be applied only to the tip, heel, and ball areas of the shank to provide cushioning and sound reduction at the critical areas while at the same time providing an aesthetically pleasing arched look to the foot. Shock absorbing material 24 may also extend to cover the platform 16 and curved radius 18. The shock absorbing material 24 located on the outside of the slipper provides cushioning for the foot and reduces noise from the impact of the slipper on a dance floor. Shock absorbing material 24 also increases the size of the curved radius 18 in the finished slipper 10, enhancing the ease of ascent and descent on pointe. Preferably, the shock absorbing materials 22 and 24 comprises a foam formed from a material selected from the group consisting of EVA, neoprene rubber or a polyurethane or layered combinations of these materials. For example, a small area of the shank may have a layer of EVA foam, with an overlayer of polyurethane foam. Most preferably, shock absorbing materials 22 and 24 are an open-celled polyurethane foam.

A stiffener 26 may be mounted on the shank 14 to provide additional support for the dancer, as shown in FIG. 4. The stiffener 26 may be generally paddle-shaped and glued to the shank 14 in a cavity formed in the underside of the shank 14, so that the exposed surface of the stiffener 26 is flush with the underside of the shank 14. In such case, the cavity 19 is larger in size at its forward end than stiffener 26. The stiffener 26 may be formed from a stiffer grade of the same material which forms the integral toe box 12 and shank 14, an is preferably formed from an ionomer resin, EVA, polyurethane, co-polyester elastomer or polycarbonate. The stiffener 26 is preferably encapsulated inside the shank 14 by overmolding to prevent delamination of the stiffener from the shank. Where the stiffener 26 is encapsulated, it is typically first injection molded, then inserted into a shank mold, and the shank and toe box unit is formed around the stiffener.

Figure 5:
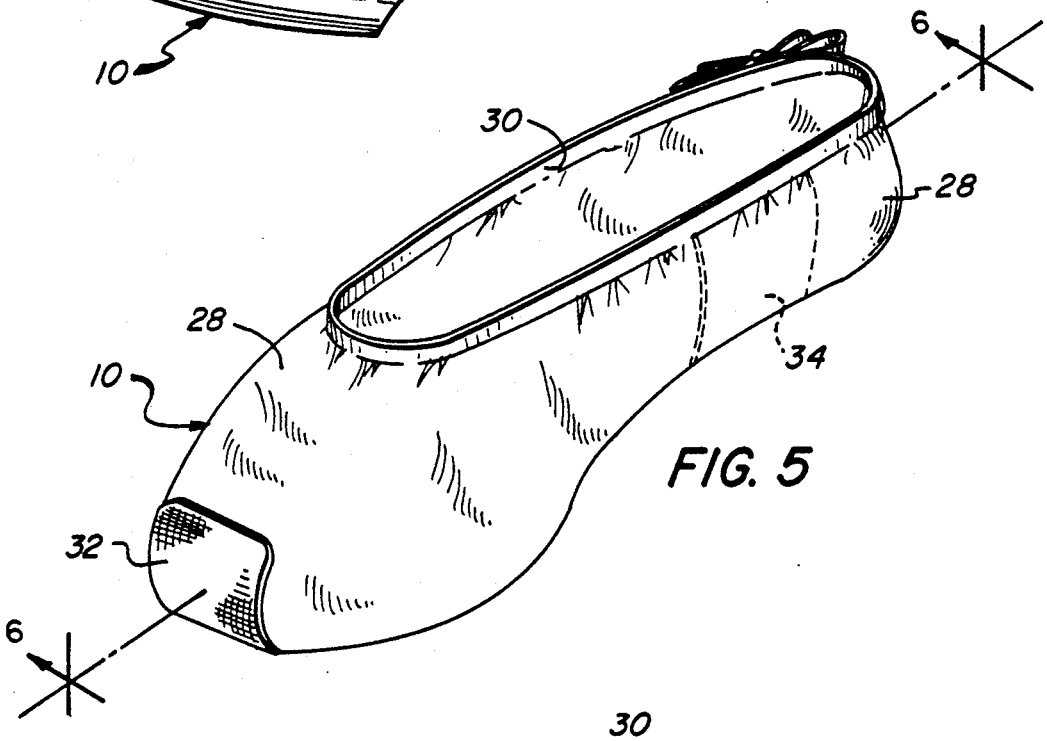
FIG. 5 is a perspective view of the assembled ballet slipper.

An outer covering 28, as shown in FIGS. 5 and 6, is made from a fabric such as silk, rayon, satin or canvas material and encloses the shank 14 and toe box 12. In one preferred embodiment, outer covering 28 includes liner materials and/or an outer shell material which is capable of wicking moisture away from the dancer's foot to the exterior of outer covering 28. The outer covering 28 fits snugly over the shank 14 and toe box 12. An elasticized throat 30 holds the slipper to the dancer's foot. Elasticized throat 30 may be a single loop of elastic material or may be an elastic drawstring. If an elastic drawstring such as shown in FIG. 5 is selected, the free ends of the drawstring are preferably located at or near the rear end of the slipper, instead of near the front as in the traditional slipper design, to reduce the painful digging of laces into the foot when the laces are tucked into the slipper as required by aesthetics and custom.

Outer covering 28 has sewn into it a panel 32 made from a durable non-slip material, preferably canvas, which covers the platform 16 and curved radius 18 of the toe box 12. Panel 32 obviates the problems of a bare plastic toe platform found in the prior art molded plastic slippers which can induce slips and falls. Panel 32 also eliminates the need to darn the tips of the slippers as is done with traditional satin-covered slipper designs. The stitching and excess fabric joining panel 32 to outer covering 28 on the upper portion of the slipper 10 fits into groove 15 to eliminate an undesirable ridge in the outer appearance of the finished slipper. Similarly, the stitching and excess fabric joining panel 32 to outer covering 28 on the lower portions of slipper 10 fits into cavity 19 surrounding stiffener 26 to provide a smooth lower surface for attaching an outer sole 36. To insure a snug fit, the outer covering 28 preferably has at least one elasticized panel 34 to hold the outer covering 28 onto the dancer's foot, the toe box 12 and shank 14. Preferably the elasticized panel 34 is located along at least one side of the slipper 10; most preferably there are two such panels 34.

Outer sole 36 is formed from a flexible shock absorbing material, preferably an EVA foam, and is secured to the outer covering 28 adjacent to the underside of the shank 14 by gluing or sewing. The outer sole 36 provides an additional cushioning layer to increase comfort and reduce noise during a performance.

A method of manufacturing a ballet slipper in accordance with the foregoing description comprises the steps of molding an integral shank and toe box from a thermoplastic polymeric material, the toe box having a platform at one toe end and a curved radius connecting the platform with the shank; lining the interior of the upper portion of the toe box with a soft resilient material sized to extend backwardly from the edges of the toe box; and attaching layers of a shock absorbing material to the upper and/or lower surfaces of the shank, and/or the outer and inner surfaces of the curved radius and platform. Preferably, the molding of the toe box and shank is accomplished by injection molding. An additional step which may be performed to increase the rigidity of the shank is the step of mounting a stiffener on the shank, which may be encapsulated in the shank. The slipper is finished by the fitting of an outer covering having a panel formed from a durable non-slip material for covering the platform and curved radius over the toe box and shank; and securing an outer sole formed from a shock absorbing material to the outer covering adjacent to the underside of said shank.

The present invention provides a durable and comfortable ballet slipper designed to be adjusted by the dancer to conform to the dancer's feet, and provides a slipper which greatly reduces the noise caused by the various aerial ballet maneuvers called for by both traditional and modern choreography, and which provides an ease in rising up to and descending from pointe not available in prior art designs.

I claim:

1. A ballet slipper comprising:

an integral shank and toe box molded from a thermoplastic polymeric material, said shank having an upper and lower surface, and said toe box having a platform exterior surface at its forward end and a curved radius exterior surface joining said platform and said shank lower surface; and a layer of resilient shock absorbing polymeric material covering at least a portion of at least one of the lower surface of said shank, the exterior surface of said platform, and the exterior surface of said radius of said toe box.

2. A ballet slipper in accordance with claim 1, wherein said layer of resilient shock absorbing polymeric material covers at least a portion of the lower surface of said shank.

3. A ballet slipper in accordance with claim 1, wherein said layer of resilient shock absorbing polymeric material covers the exterior surface of said curved radius.

4. A ballet slipper in accordance with claim 1, wherein said layer of resilient shock absorbing polymeric material covers the exterior surface of said platform.

5. A ballet slipper in accordance with claim 1, further comprising a layer of resilient shock absorbing polymeric material covering at least a portion of the upper surface of said shank.

6. A ballet slipper in accordance with claim 1 wherein said shank and toe box thermoplastic polymeric material has a softening point between about 120° F. and about 220° F.

7. A ballet slipper in accordance with claim 1 wherein said shank and toe box thermoplastic polymeric material is an ionomer resin, ethylene-vinyl acetate copolymer, polyurethane, thermoplastic rubber or co-polyester elastomer.

8. A ballet slipper in accordance with claim 1, wherein said layer of resilient shock absorbing polymeric material covering at least a portion of at least one of the lower surface of said shank, the exterior surface of said platform, and the exterior surface of said radius of said toe box is a foam formed from ethylene-vinyl-acetate copolymer, neoprene rubber or polyurethane.

9. A ballet slipper in accordance with claim 8 wherein said layer of resilient shock absorbing material comprises an open celled polyurethane foam.

10. A ballet slipper in accordance with claim 1, further comprising an outer covering fitted over said integral shank and toe box, said outer covering comprising material having wicking qualities to transport moisture from the shank and toe box to an outer surface of said outer covering.

11. A ballet slipper in accordance with claim 1, wherein said layer of resilient shock absorbing polymeric material comprises multiple layers of polymeric foams.

12. A ballet slipper in accordance with claim 8, wherein said layer of resilient shock absorbing polymeric material further comprises multiple layers of said foams.

13. A ballet slipper in accordance with claim 10, further comprising an outer sole formed from a flexible shock absorbing material secured to said outer covering adjacent to said shank.

14. A ballet slipper comprising:

an integral shank and toe box molded from a thermoplastic polymeric material, said toe box including a platform at its forward end and a curved radius joining said platform and said shank, said shank having upper and lower surfaces;

a first layer of resilient shock absorbing material covering at least a portion of the upper surface of said shank;

a second layer of resilient shock absorbing material covering at least a portion of the lower surface of said shank and said curved radius and platform.

15. A ballet slipper in accordance with claim 14 wherein said shank and toe box thermoplastic polymeric material is an ionomer resin, an ethylene-vinyl acetate copolymer, a polyurethane, a thermoplastic rubber, or a co-polyester elastomer.

16. A ballet slipper in accordance with claim 14 wherein said first and second layers of resilient shock absorbing material comprise a foam formed from an ethylene-vinyl acetate copolymer, neoprene rubber, or polyurethane.

17. A ballet slipper in accordance with claim 14, wherein said first and second layers of resilient shock absorbing material comprise multiple layers of different foams.

18. A ballet slipper in accordance with claim 16 wherein said first and second layers of resilient shock absorbing material comprise a layered combination of foams formed from ethylene-vinyl acetate copolymer, neoprene rubber, or polyurethane.

19. A ballet slipper in accordance with claim 14, further comprising an outer covering formed from a material having wicking qualities to transport moisture therethrough.

20. A method of manufacturing a ballet slipper, comprising the steps of:

molding a shank and a toe box integrally together form a thermoplastic polymeric material, said shank having upper and lower surfaces, said toe box having a platform surface at a forward end of said toe box, said toe box further having a curved radius surface connecting said platform with said shank lower surface; and attaching a resilient shock absorbing material to at least a portion of at least of the lower surface of sad shank, said curved radius surface and said platform surface.

* * * * *